United States Patent [19]

Mollenkopf

[11] 4,119,287

[45] Oct. 10, 1978

[54] SUPPORTS FOR MOVABLE PARTITIONS

[75] Inventor: Lloyd C. Mollenkopf, Eagan, Minn.

[73] Assignee: Rosemount Office Systems, Inc., Lakeville, Minn.

[21] Appl. No.: 710,899

[22] Filed: Aug. 2, 1976

[51] Int. Cl.[2] ..... A47G 29/02

[52] U.S. Cl. ..... 248/243; 248/224.4

[58] Field of Search ..... 52/36; 211/191-193, 211/207, 208; 248/219.1, 220.2, 220.3, 220.4, 221.2, 241, 243, 224.4

[56] References Cited

U.S. PATENT DOCUMENTS

| | | | |
|---|---|---|---|
| 392,061 | 10/1888 | Peckham | 248/243 X |
| 1,288,010 | 12/1918 | Isaac | 248/243 X |
| 3,018,900 | 1/1962 | Huet | 211/193 |
| 3,189,140 | 6/1965 | Luss | 52/36 X |
| 3,517,467 | 6/1970 | Propst et al. | 52/36 |
| 3,733,755 | 5/1973 | Butler | 211/191 X |
| 3,759,297 | 9/1973 | Anderson et al. | 248/243 X |
| 3,794,281 | 2/1974 | Munsey | 248/188 |
| 3,886,698 | 6/1975 | Raith | 52/36 |
| 3,908,320 | 9/1975 | Hogue | 52/36 |
| 3,921,347 | 11/1975 | Paisley | 52/36 |
| 3,924,829 | 12/1975 | Boundy | 248/243 |

FOREIGN PATENT DOCUMENTS

| | | | |
|---|---|---|---|
| 264,367 | 12/1965 | Australia | 248/243 |
| 216,172 | 7/1961 | Austria | 248/243 |
| 665,000 | 10/1965 | Belgium | 211/191 |
| 446,644 | 3/1968 | Switzerland | 211/192 |
| 1,198,887 | 7/1970 | United Kingdom | 248/243 |
| 1,368,089 | 9/1974 | United Kingdom | 248/243 |

*Primary Examiner*—Lawrence J. Staab
*Attorney, Agent, or Firm*—Nickolas E. Westman

[57] ABSTRACT

An accessory support system for attaching accessories, such as shelves, desk tops and book cases to movable wall partitions or panels used for dividing interior spaces into modules. The support system provides a secure, safe and concealed means for removably and adjustably attaching the accessories to the panels.

7 Claims, 4 Drawing Figures

SUPPORTS FOR MOVABLE PARTITIONS

BACKGROUND OF THE INVENTION

1. Field of the Invention

The present invention relates to a support arrangement for attaching accessories to movable partitions or panels.

2. Prior Art

In the prior art various support devices have been used for attaching shelves or the like to individual partition panels. U.S. Pat. No. 3,517,467 shows a support clip that fits into provided openings in a vertical member at the corner of a unit. The receptacles that hold this support clip are in an angled vertical member and the two parts hook together. U.S. Pat. No. 3,794,281 also shows a hook type retainer with vertical slots formed in a vertical post at the end of a moveable partition, but the slots themselves are visible when the supports are not in position, and generally the use of such visible slots will tend to detract from the appearance of the panel. A hook type fastener used with partitions is shown in U.S. Pat. No. 3,886,698. A cover member for concealing the slots is used, and apparently it is spring loaded so that it will move out of the way when a retainer is put into place. U.S. Pat. No. 3,759,297 also shows a hook type retainer used in vertical slots on a movable partition.

U.S. Pat. No. 3,189,140 shows a type of interlocking member for supporting structures, and there are provided holes or apertures that receive hooks that are bent at right angles to the support. Other patents showing general releasable support structures include U.S. Pat. Nos. 3,759,297, 3,924,829, 3,908,320 and 3,921,347.

SUMMARY OF THE INVENTION

A support structure for use with movable office partitions comprising a vertical post at the end of each partition or panel which has receptacles formed thereon, and a support member having complimentary hooks that will fit into the receptacles and be retained thereby and which can be used for supporting shelves, desk tops and other accessories on the surface of the wall panel. The end post of the panels are assembled with a cover shield which shields the attaching receptacles from view, but yet permits the insertion of the hooks on the support members at any desired level without distorting, bending or moving the cover shield substantially.

The device is simple to make and use, and very attractive because of the use of the shielding member that hides the actual joining portions of the support.

DESCRIPTION OF THE PREFERRED EMBODIMENT

For overall appreciation of the type of modular panels that are being referred to in this description, reference is made to U.S. Pat. No. 3,605,851. The panels are used for interior office partitions, and generally comprise flat panels which may have central support sheets covered with fabric such as a pile fabric. Vertical support post members are provided at the opposite vertical edges of each panel. Suitable molding strips also can be placed at the upper and lower horizontal edges, for decorative purposes and for protection of the edges of the device.

Figure 1:
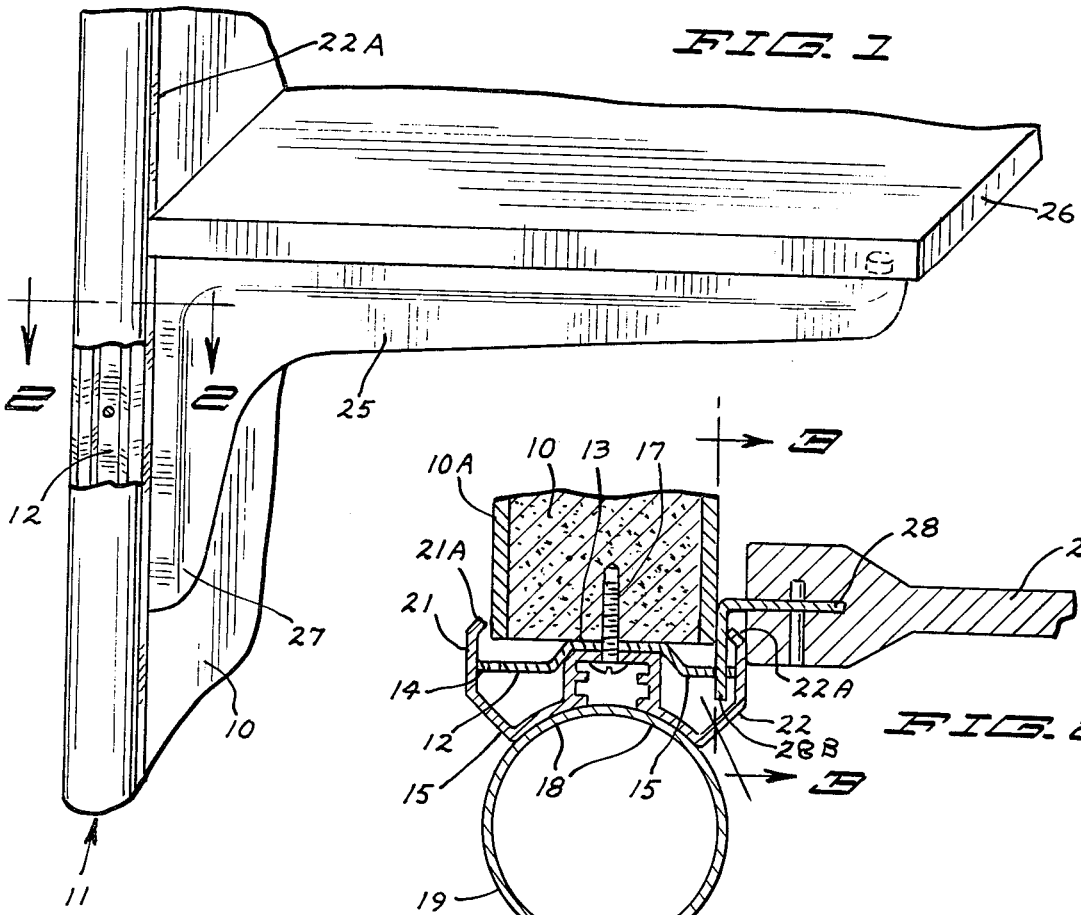
FIG. 1 is a fragmentary perspective view of a typical support member installed in a panel having support portions made according to the present invention.
Figure 2:
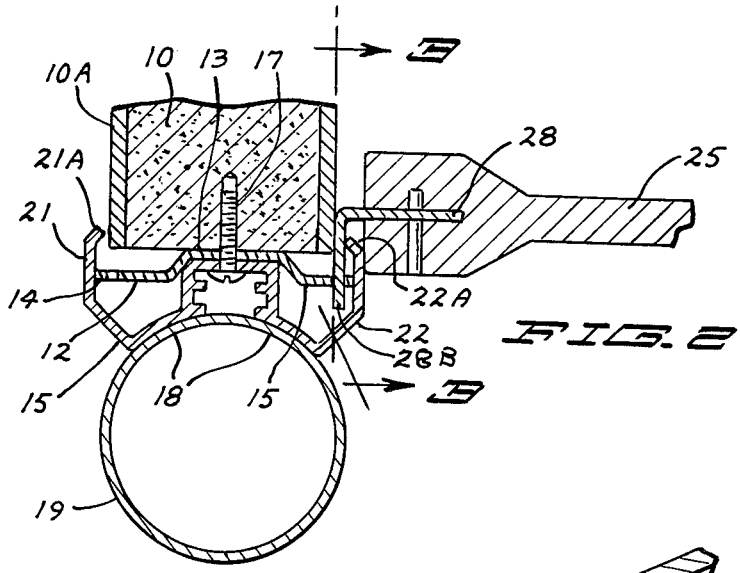
FIG. 2 is a sectional view taken as on line 2—2 in FIG. 1.
Figure 4:
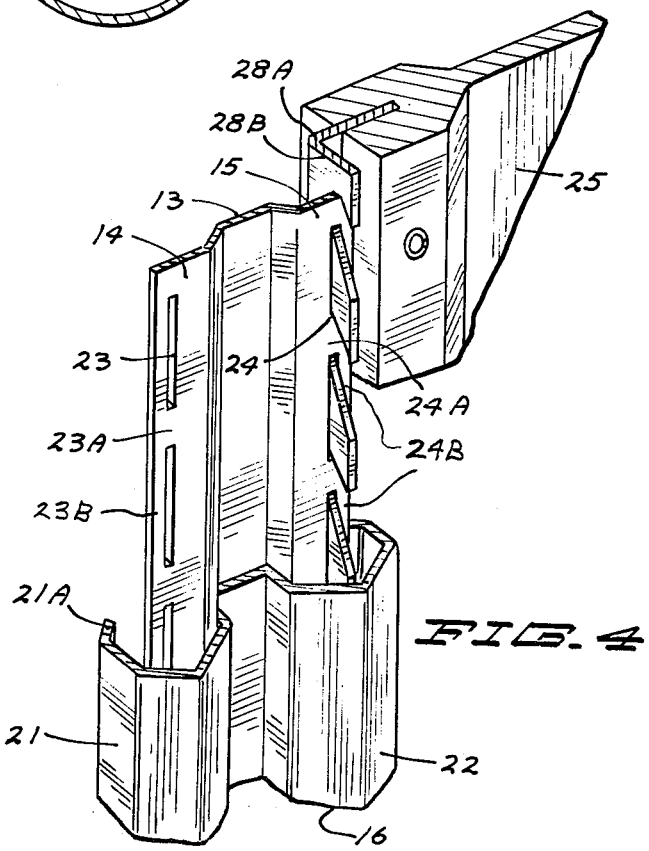
FIG. 4 is a perspective view of the support shown in FIG. 1 with parts in section and parts broken away to show the mounting arrangement.

Referring to FIG. 1, a modular movable wall panel illustrated generally at 10, which is shown only fragmentarily, has a vertical side support post arrangement 11, which is shown in greater detail in FIGS. 2 and 4. The panel itself can be made up of a number of layers of material, and for example can have a resilient or carpet type fabric layer 10A at the outer face thereof. The panels generally are rectangular with vertical supports at the opposite end edges.

The end of the panel 10 in the form shown includes a vertical support member 12 that has a center base portion 13 fastened to the edge of the panel 10 and which support member has edge flanges 14 and 15 at opposite vertical sides thereof. The flanges 14 and 15 are offset from the base member 13 by angled junction portions. The flanges 14 and 15 are thus spaced from the end surface of the panel 10, as shown in FIG. 2 and extend laterally out beyond the planes of the side faces of the panel 10 slightly. An extruded vertical support member 16 overlies the vertical member 12. The support 16 has a center portion that is attached to the panel with suitable screws or other fasteners 17 which also pass through member 12, and forms a saddle type support indicated generally at 18 for receiving a vertical post 19. The post 19 is attached to he extrusion 16 in the manner described in the aforementioned U.S. Pat. No. 3,605,851, or in other suitable ways.

The extrusion 16 also includes side shield members 21 and 22 that extend from the saddle portion 18 back toward opposite sides of the panel 10, and these side shield members 21 and 22 pass beyond the outer edges of the vertical flanges 14 and 15, respectively. The side shield members 21 and 22 have bent tab portions 21A and 22A, respectively that are positioned closely adjacent to the outer side surfaces of the opposite sides of the panel 10. The tab portions 21A and 22A can be slightly resilient and can be sprung out away from the surfaces of the support panels if desired.

Each of the vertical flanges 14 and 15 have, as perhaps best seen in FIG. 4, a series of vertically extending slot like apertures 23 and 24 on opposite edges, respectively, spaced vertically at regular intervals. It should be noted that the slot like apertures 23 and 24 do not have to be closed sided slots, but could be formed as partially open slots formed in a C shape with small vertical wall extensions at the top and bottom of each of the slots.

Figure 3:
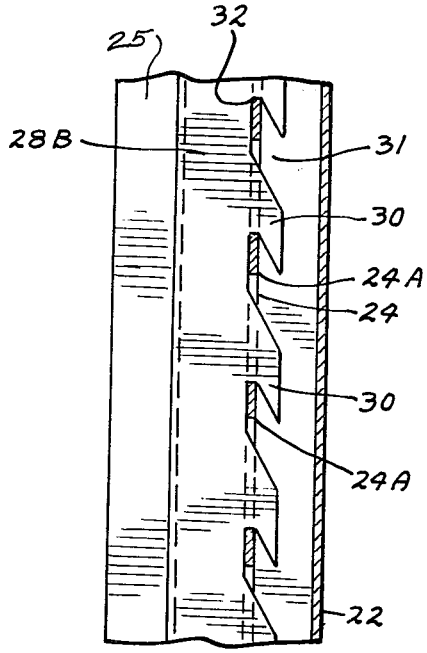
FIG. 3 is a sectional view taken as on line 3—3 in FIG. 2.

A typical accessory support member indicated generally at 25, as shown is for supporting a shelf 26. The support member itself can be of any desired configuration such as that shown, or can be used for supporting desk tops, book cases, or other members as well as the shelf 26. The accessory support has a vertically extending portion 27 as shown. A connector flange 28 is fixed to the portion 27. The attachment flange 28 has a portion 28A that extends perpendicular to the general plane of the panel 10, and a support leg portion 28B at right angles to the portion 28A. The support leg portion 28B is formed into a plurality of hook members indicated generally at 30 with spaces 31 between the hook members. The hook members have bight portions 32 that form receptacles (see FIG. 3) at the upper parts of the hooks to receive the horizontal cross bars 23A and 24A between the slots 23 and 24 respectively. Thus, these cross bars 23A and 24A support the hooks 30 of support portion 28B, and carry sufficient load to support the shelf or other accessory that might be attached to the panel.

Further, the vertically extending wall portions 24B on the outside of the slots 24A will prevent the hooks from slipping out of the slots in direction perpendicular to the plane of the panel under load. As stated these vertically extending walls could be partially removed to form C shaped slots.

The hooks can easily be slid behind the shield members 21 and 22 by moving leg portion 28B parallel to the plane of panel 10, so that the hooks fit between the face 10A of the panel and the end portions 21A or 22A of the shield. The hooks can then be slipped into the respective slots 23 or 24, moved downwardly so that the receptacles or bight portions 32 seat securely on the adjacent cross bars 23A or 24A and then the accessory support member is properly supported in place.

High strength is achieved by this manner because the slots 23 can be formed in the flanges 14 and 15 that have adequate strength for supporting any desired load, and yet the hooks and slots are generally concealed well enough so that they are for all practical purposes invisible to the eye and do not interfere with the decor. The cover members 21 and 22 of course contribute greatly to this shielding, and there is no need for provision of spring material other than ordinary aluminum extrusions.

The entire assembly can be made of a suitable extrusion so that the cost is kept low, and the user has the ability to change position of the supports for true modular forming of offices and the like.

It should be noted that the supports 25 are made in right and left hand, so that the supports can be placed at opposite ends of a wall panel. Thus, two spaced supports 25 would be used to support a desk top, shelf or the like; one would be left hand, and one would be right hand.

Also suitable means can be used on the horizontal portion of the support to secure the shelf or other accessory in position.

If a book case or desk top is to be supported, the main portion of the support member may be a rectangular panel, but would include the member 28 and leg 28B that has the hooks which are moved into the slots behind the shield member.

The load on the shelf or other accessory is thus cantilevered out and the lower end of member 28 is loaded toward the panel 10, while the upper parts tend to be pulled away from the panel. The vertical wall portions 23B and 24B between the slots and the outer edges of the flanges 14 and 15 provide adequate restraining power.

What is claimed is:

1. In combination, a movable wall panel having a side wall surface and upright end edges, a generally vertical member extending along at least one upright edge of the panel and fixed to said wall panel, said vertical member including an edge portion extending generally normal to the side wall surface and extending outwardly from the side wall surface, a support bracket having a main portion and a leg portion generally parallel to the side wall surface when the main portion extends outwardly from the side wall surface, cooperating hook and slot means on the portion of the vertical member extending outwardly from the side wall surface and on the leg portion of said support bracket, said hook and slot means being engagable upon movement of said leg portion in direction generally parallel to the side wall surface with the main portion of the support protruding from the side wall surface, and a cover strip attached to said wall panel and having a shield portion overlying said vertical member, said shield portion extending along said side wall surface and being spaced closely from the side wall surface, said leg portion moving between said side wall and said shield portion when the cooperating hook and slot means are moved to be engaged.

2. The combination of claim 1 wherein said edge portion of said vertical member has a plurality of slots positioned one on top of the other and spaced by cross bars formed as part of the edge portion.

3. The combination of claim 2 wherein said slot means in said edge portion are at least partially enclosed by vertical walls to the outside of the slot means.

4. The combination of claim 2 wherein said leg portion has hook means formed with a bight portion which passes through a slot means and engages a cross bar upon downward movement of the leg portion after engagement with the slot means.

5. The combination of claim 4 wherein said leg portion includes a plurality of hooks each engageable with separate slot means vertically spaced from each other.

6. The combination of claim 1 wherein said vertical support member has edge portions protruding from the opposite side walls of the wall panel and each of said edge portions including means to support a support member on opposite sides of said panel.

7. In combination, a movable wall panel having a narrow edge surface extending between oppositely facing generally upright side wall surfaces, and having an upright support member extending along at least one upright edge surface of the wall panel, said upright support member including a portion extending generally parallel to the edge surface and extending outwardly from the side wall surface of one side wall, a plurality of vertically spaced slots defined in said portion of said upright support member, said slots being positioned outwardly from the surface of said one side wall and facing generally perpendicular to the one upright edge surface, a support bracket having a main portion and a leg portion, said leg portion being positioned generally perpendicular to the plane of the one edge surface when the main portion of the support bracket extends outwardly from the one side wall, hook means formed in an outwardly facing edge of said leg portion, said hook means being engagable with said slots upon movement of said edge of said leg portion in direction toward said slots and along the one side wall with the main portion of the support bracket protruding outwardly from the side wall and on a side of said outwardly extending portion of said upright support member toward said side wall, and a cover strip attached to said wall panel along said one upright edge surface and having a shield portion overlying said upright support member, said shield portion extending around the outwardly extending portion of the upright support member along the one side wall and being spaced closely from the surface of said one side wall, said leg portion moving between said surface of said one side wall and said shield portion when the hook means are moved to be engaged with said slots.

* * * * *